US007140517B2

(12) United States Patent
Masuda

(10) Patent No.: US 7,140,517 B2
(45) Date of Patent: Nov. 28, 2006

(54) VALVE MECHANISM FOR TUBE SHAPED FLUID CONTAINER

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 106 days.

(21) Appl. No.: 10/640,745

(22) Filed: Aug. 14, 2003

(65) Prior Publication Data

US 2004/0069815 A1 Apr. 15, 2004

(30) Foreign Application Priority Data

Aug. 20, 2002 (JP) ..... 2002-238832
Nov. 14, 2002 (JP) ..... 2002-330810

(51) Int. Cl.
*B65D 35/50* (2006.01)

(52) U.S. Cl. ..... 222/213; 222/496

(58) Field of Classification Search ..... 222/212, 222/213, 490, 491, 494, 495, 496
See application file for complete search history.

(56) References Cited

U.S. PATENT DOCUMENTS 1,911,284 A 5/1933 Nichols
1,922,204 A * 8/1933 Johnson ..... 222/494
1,945,872 A * 2/1934 Tappe ..... 222/496
1,982,294 A * 11/1934 Griffin ..... 222/496
2,550,356 A 4/1951 Jarvis
3,107,035 A * 10/1963 Cholet ..... 222/213
3,165,242 A * 1/1965 Jackson ..... 222/495
3,244,332 A * 4/1966 Rogers ..... 222/213
3,456,650 A * 7/1969 Schwartzman ..... 222/495
3,506,162 A * 4/1970 Schwartzman ..... 222/496
3,754,690 A * 8/1973 Marchant ..... 222/494
3,874,563 A * 4/1975 Schwartzman ..... 222/213
4,420,101 A 12/1983 O'Neill
6,095,381 A * 8/2000 Schwanenberg ..... 222/494

FOREIGN PATENT DOCUMENTS

| | | |
|---|---|---|
| DE | 849186 A1 | 6/1998 |
| DE | 201 16 142 U1 | 1/2002 |
| EP | 0 302 575 A1 | 2/1989 |
| FR | 1092480 | 4/1955 |
| FR | 1354498 | 3/1964 |
| JP | 08-026311 | 1/1996 |
| JP | 08-034452 | 2/1996 |
| JP | 2001-278297 | 10/2001 |

* cited by examiner

*Primary Examiner*—Eric Keasel
(74) *Attorney, Agent, or Firm*—Knobbe, Martens, Olson & Bear LLP

(57) ABSTRACT

A valve mechanism for a tube-type fluid container includes a valve seat portion having an upper opening portion and a lower opening portion; and a valve portion disposed co-axially with the upper opening portion. The valve portion includes a supporting portion attached at or below the lower opening portion, a closing portion for closing the upper opening portion, and a connecting portion connecting the closing portion and the supporting portion. At least either the closing portion or the connecting portion is resilient and capable of being deformed to open the upper opening portion when a fluid stored inside the container is pressed.

21 Claims, 14 Drawing Sheets

VALVE MECHANISM FOR TUBE SHAPED FLUID CONTAINER

BACKGROUND OF THE INVENTION

The present invention relates to a valve mechanism, particularly to a valve mechanism which can be used for a tube-type fluid container.

In this type of tubular container, recently, instead of conventional tubes comprising a metal or an aluminum-foil-laminated material, tubes comprising a synthetic resin alone or a lamination of a synthetic resin and aluminum (hereinafter referred to as "synthetic resin made" materials) have been used.

In the case of a tube-type container using a synthetic resin made tube, because these synthetic resin made tubes have elasticity recovering force, the following problem occurs: When the pressure is released after a fluid is discharged by pressing the tube, air flows back from an opening portion for discharging the fluid to the fluid storing portion due to the elasticity recovery of the tube, contributing deterioration of the quality of the fluid stored.

For this reason, a tube-type container, in which a tabular valve body is provided in an opening portion for discharging the fluid and the opening portion is closed by this valve body when the shape of the tube is elastically restored, has been proposed (e.g., Japanese Patent Laid-open No. 1995-112749, Japanese Patent Laid-open No. 1998-157751, Utility Model Registration Application No. 1984-26748, etc.).

Thus, in the conventional tube-type container in which the above-mentioned tabular valve body is provided, if the tube recovers its original shape by its elasticity slowly, the valve body fails to close the opening portion of the tube-type container and air may flow back to the fluid storing portion.

Additionally, the conventional tube-type container in which the above-mentioned tabular valve body is provided, has a problem in its low durability.

Further, in the above type of valve mechanism, conventionally, as described in the Japanese Patent Laid-open No. 2001-179138, a valve mechanism having a spherical valve body and a spring for giving momentum to the valve body toward a valve seat has been used.

Manufacturing the valve mechanism using the spherical valve body and the spring, however, tends to be very expensive. Consequently, a valve mechanism, which has a valve seat, and a valve body which moves between a closed position in which the valve body is in contact with the valve seat and an open position in which the valve body is separated from the valve seat, is commonly used.

In this valve mechanism, it is preferred that the valve mechanism can close a fluid reliably although its configuration is simple. Additionally, it is preferred to provide a configuration which can change a flow rate of the fluid passing through it discretionally according to a pressure applied to the fluid. As matters stand, however, a valve mechanism possessing these requirements has not been reported.

SUMMARY OF THE INVENTION

The present invention has been achieved to solve the above-mentioned problems. It aims to provide a valve mechanism which can close a fluid reliably while its configuration is simple and which can alter a flow rate of the fluid passing through the valve mechanism discretionally according to a pressure applied to the fluid.

The present invention includes, but is not limited to, the embodiments explained below. Solely for the sake of understanding some embodiments of the present invention easily, reference numerals used in the figures explained later are referred to. However, the present invention is not limited to the structures defined by these reference numerals, and any suitable combination of elements indicated by these reference numerals can be accomplished.

In an embodiment, a valve mechanism (e.g., 2, 2', 2", 10) adapted for a mouth portion (e.g., 12, 141) of a tube-type fluid container (e.g., 1, 140), comprising: (a) a valve seat portion (e.g., 4, 4', 4", 30) having an upper opening portion (e.g., 41, 46, 132) and a lower opening portion (e.g., 44, 49, 131) through both of which a fluid passes, said valve seat portion adapted to be attached to the mouth portion of the container; and (b) a valve portion (e.g., 3, 3', 20) disposed co-axially with the upper opening portion, comprising: (i) a supporting portion (e.g., 34, 37, 23) attached at or below the lower opening portion without closing the lower opening portion, (ii) a closing portion (e.g., 32, 38, 21) for closing the upper opening portion, said closing portion having an outer diameter (e.g., D1, D1', D1") larger than an inner diameter (D2, D2', D2") of the upper opening portion; and (iii) a connecting portion (e.g., 33, 36, 22) connecting the closing portion and the supporting portion, wherein at least either the closing portion or the connecting portion is resilient and capable of being deformed to open the upper opening portion when a fluid stored inside the container is pressed. In the above, the upper opening portion may be a valve seat (e.g., 41, 46) or an inner wall (e.g., 132) which is in contact with the closing portion to close or seal an opening or a flow path (42, 42').

The present invention includes, but is not limited to, the following configurations in other embodiments: The supporting portion, the closing portion, and the connecting portion may be integrally formed. The connecting portion (e.g., 33, 36) may be resilient and capable of being stretched in a direction of the fluid flow. The closing portion (e.g., 21) may be a resilient annular edge portion which is capable of being deformed in a direction of the fluid flow. The valve seat portion (e.g., 4', 4", 30) may have a shape to be fitted in an inner circumferential portion (e.g., 13, 143) of the mouth portion of the container. Alternatively, the valve seat portion (e.g., 4) may have a shape to be fitted around an outer circumferential portion (e.g., 14) of the mouth portion of the container.

In an embodiment, the connecting portion (e.g., 22, 36) may have an outer circumferential surface which is tapered outward in a direction of the fluid flow. The lower opening portion of the valve seat portion comprises multiple slits (e.g., 131) each formed in a radial direction.

Further, in an embodiment, the valve seat portion (e.g., 30) may be cup-shaped, and the upper opening portion may be formed by an inner circumferential surface (e.g., 132) of the cup-shaped valve seat portion, wherein the resilient annular edge portion (e.g., 21) may be in contact with the inner circumferential surface of the cup-shaped valve seat portion to close the upper opening portion when a fluid stored inside the container is not pressed. The resilient annular edge portion may be hollow.

In another embodiment, the valve seat portion (e.g., 4) constitutes a nozzle and the closing portion (e.g., 32) of the valve portion is spherically shaped, wherein the upper opening portion is shaped to fit for the spherically shaped closing portion. The spherical valve portion may have recesses (e.g., 35) on its top.

In another aspect of the present invention, a tube-type fluid container (e.g., 1) may comprise a container body (e.g., 11) for storing a fluid having a mouth portion (e.g., 12, 141), and the valve mechanism described above attached to the mouth portion. In an embodiment, the valve seat portion of the valve mechanism may be fitted in the mouth portion, wherein the mouth portion has an annular flange (e.g., 13) and the valve seat portion has an outer circumferential surface having an annular recess (e.g., 50, 50', 135) fitted in the flange. In the above, the container may further comprise a lid portion (e.g., 5) having a discharge hole (e.g., 54), wherein the mouth portion has an outer circumferential surface provided with male threads (e.g., 14), and the lid portion has an inner circumferential surface connected to the discharge hole and provided with female threads (e.g., 53) fitted to the male threads.

Alternatively, the valve seat portion of the valve mechanism may be fitted around an outer circumferential surface of the mouth portion, wherein the outer circumferential surface is provided with male threads (e.g., 14) and the valve seat portion has an inner circumferential surface provided with female threads (e.g., 45) fitted to the male threads.

In the present invention, any combination of the elements described above can be accomplished, and the present invention should not be limited to the above embodiments.

According to an embodiment or embodiments of the present invention, a fluid flow can be shut off reliably although a configuration is simple; it becomes possible to change a flow rate of the fluid passing through the opening discretionally according to a pressure applied thereto, without reverse flow of air through the outlet.

In the above, the fluid can be discharged from an outlet of the mouth portion of the container through the valve mechanism by pressing the container, wherein the connectors and the container are deformed. When releasing the pressure, both the deformed valve portion and the deformed container begin restoring the shapes. The restoring force of the container causes the inner pressure to lower, thereby generating reverse flow which facilitates restoration of the connectors to close the opening of the valve seat portion, thereby effectively preventing air from coming into the container through the outlet of the mouth portion. Thus, even if the restoring force of the connectors themselves is not sufficient to close the opening of the valve seat portion, the outlet of the mouth portion can effectively be closed in combination with the restoring force of the container. Thus, even if the fluid is very viscous, the valve mechanism in combination with the container can discharge the fluid and then seal the container.

For purposes of summarizing the invention and the advantages achieved over the related art, certain objects and advantages of the invention have been described above or will be described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 4A is a top view and FIG. 4B is a side view.

FIG. 7A is a top view and FIG. 7B is a side cross-sectional view.

FIG. 9A shows a structure when no pressure is applied, and FIG. 9B shows a structure when pressure is applied.

FIGS. 13A, 13B, and 13C are a top view, a side cross-sectional view, and a side view, respectively.

FIGS. 14A, 14B, and 14C are a side cross-sectional view, a side view, and a bottom view, respectively.

Figure 1:
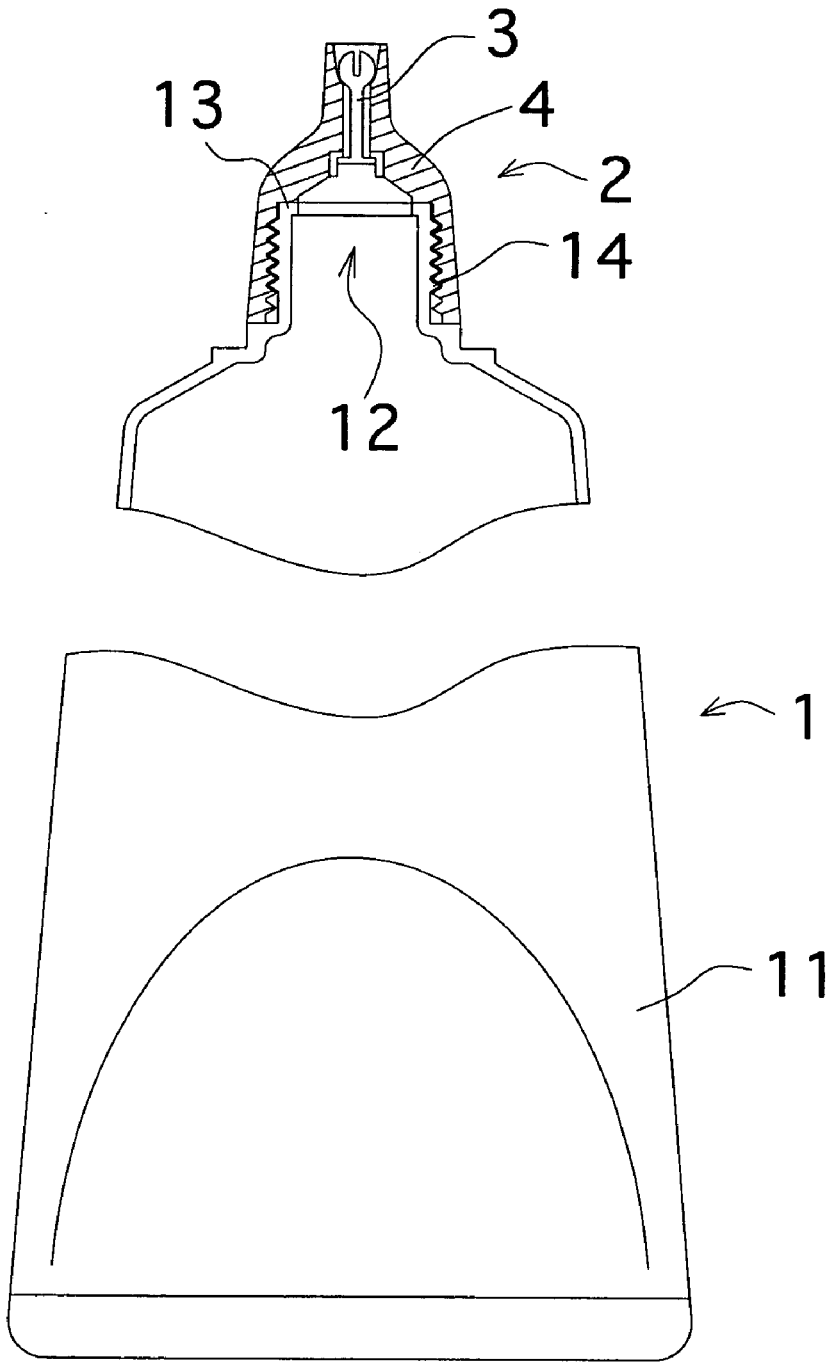
FIG. 1 is a longitudinal sectional view showing the tube-type fluid container according to Embodiment 1 of the present invention.

Explanation of symbols used is as follows: 1: Container main unit; 2: Valve mechanism; 3: Valve portion; 4: Valve seat portion; 5: Lid material; 11: Fluid storing portion; 12: Discharge port; 13: Flange portion; 14: Male screw portion; 32: Valve body; 33: Coupling portion; 34: Base portion; 35: Groove portion; 36: Coupling portion; 37: Base portion; 38: valve body; 41: Valve seat body; 42: Flow hole; 43: Engaging portion; 44: Opening portion; 45: Female thread portion; 46: Valve seat body; 47: Tubular portion; 48: Engaging portion; 49: Opening portion; 50: Concave portion; 51: Base portion; 52: Upper lid; 53: Female thread portion; 54: Discharge port; 55: Closed portion; 10: Valve mechanism; 20: Valve portion; 21: Valve body; 22: Coupling portion; 23: Base portion; 30: Supporting material; 131: Flow hole; 132: Inner circumferential surface; 133: Engaging portion; 134: Bottom; 135: Engaging groove; 110: Lid material; 111: Lid body; 112: Female screw portion; 140: Container main unit; 141: Opening portion; 142: Fluid storing portion; 143: Flange portion; 144: Male screw portion E1, E2, E3, and E4: Edge contact.

DETAILED DESCRIPTION OF THE PREFERRED EMBODIMENT

Preferred embodiments of the present invention will be described with referent to the drawings. The present invention is not limited to these embodiments.

An embodiment of the present invention may be characterized in that a tube-type fluid container comprises a tubular container main unit at one end of which a fluid discharge port (mouth portion) is formed and a valve mechanism arranged at the discharge port, wherein the valve mechanism comprises a valve portion made of an elastic material and having a base portion (supporting portion), a valve body (closing portion) and a coupling portion (connecting portion) connecting the base portion and the valve body, and a valve seat portion having an engaging portion (lower opening portion) which engages with the base portion and a valve seat body (upper opening portion) which is arranged at a position separated from the engaging portion at a distance corresponding to a size of the coupling portion and can contact the valve body; which valve mechanism is characterized in that, when a pressure is applied to a fluid inside the tube-type container main unit, the valve body is detached from the valve seat body by the elasticity of the coupling portion.

According to the above embodiment, because the valve mechanism has a configuration in which the valve body separates from the valve seat body by the elasticity of the coupling portion in the valve portion when a pressure is applied to the fluid inside the tubular container main unit, it becomes possible to prevent the reverse flow of air reliably in spite of a simple configuration, and excellent durability is also accomplished.

Another embodiment of the present invention may be characterized in that a male thread portion is formed on an outer circumferential portion of an opening portion in the tubular container main unit, and a female thread portion which can screw together with the male thread portion is formed on an inner circumferential portion of the valve seat portion.

According to the above embodiment, because the male thread portion is formed on the outer circumferential portion of the opening portion in the tubular container main unit and the female thread portion which can screw together with the male screw portion is formed on the inner circumferential portion of the valve seat portion, it becomes possible to insert/remove the valve mechanism into/from the tube-type container easily.

Still another embodiment of the present invention may be characterized in that a flange portion is formed in the opening portion in the tubular container main unit and a concave portion which can engage with the flange portion is formed on the outer circumferential portion of the valve seat portion.

According to the above embodiment, because the flange portion is formed in the opening portion in the tubular container main unit and the concave portion which can engage with the flange portion is formed on the outer circumferential portion of the valve seat portion, it becomes possible to insert/remove the valve mechanism into/from the tube-type container easily.

FIGS. 1 through 8B show particular examples of the above embodiments.

The present invention includes other embodiments. That is, an embodiment may be characterized in that a valve portion made of an elastic body material comprises a flexible hollow valve body (closing portion) having a nearly conical shape, a base portion (supporting portion), and a coupling portion (connecting portion) which couples the valve body and the base portion; and a supporting material (valve seat portion) has a tubular shape (constituting an upper opening portion) with a bottom, the inside diameter of which is smaller than the maximum outside diameter of the valve body of the valve portion, the bottom of which engages with the base portion of the valve portion, the inner circumferential surface of which contacts the valve body of the valve portion, wherein flow holes for passing a fluid therethrough are formed in an area closer to the bottom side (lower opening portion) than an area in which the inner circumferential surface of the supporting material and the valve body of the valve portion come in contact with each other. In the above, when a pressurized fluid flows in from the flow holes, the maximum outside diameter of the valve body becomes smaller than an inside diameter of the supporting material by the flexibility of the valve body of the valve portion, and the valve body is detached from the supporting material, whereby a fluid path is formed.

According to the above embodiment, when a pressurized fluid flows in from the flow holes, a fluid flow path is formed as the valve body separates from the supporting material and the maximum outside diameter of the valve body becomes smaller than the inside diameter of the supporting material by the flexibility of the valve body in the valve portion. As a result, the fluid can be closed reliably while the invention has a simple configuration. Additionally, a fluid flow rate passing through the invention can be changed discretionally according to a pressure applied to it.

Yet another embodiment of the present invention may be characterized in that the inner circumferential surface in the supporting material has a tapered shape, an inside diameter of which becomes larger as it is away from the bottom.

According to the above embodiment, because the inner circumferential surface in the supporting material has a tapered shape whose inside diameter becomes larger as it separates from the bottom, even if an amount of deformation of the valve body is minute, securing clearance gaps for discharging the fluid effectively becomes possible.

FIGS. 9 through 13C show particular examples of the above embodiments.

The present invention should not be limited to the above embodiments and the examples explained below, and further, any combination of the respective elements of any embodiment can be accomplished as long as at least one advantage described above is realized.

EXAMPLES

Preferred embodiments of the present invention are described with referent to the drawings. FIG. 1 is a longitudinal section of the tube-type fluid container according to the Embodiment 1 of the present invention.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc. In this specification, regular liquids, high-viscosity liquids, semifluids, gels that sol solidifies to a jelly, and creams are all referred to as fluids.

This tube-type fluid container comprises a container main unit 1 and a valve mechanism 2.

The above-mentioned container main unit 1 possesses a tubular fluid storing portion 11 for storing a fluid inside it, a fluid discharge port 12 formed at one end of the fluid storing portion 11, a flange portion 13 formed in the vicinity of the upper end of the discharge port 12, and a male screw portion 14 formed on the outside of the discharge port 11. This container main unit 1 comprises a synthetic resin alone or a lamination of a synthetic resin and aluminum and has an elasticity recovering force which tries to recover its original shape when a pressure applied to it is removed.

Figure 2:
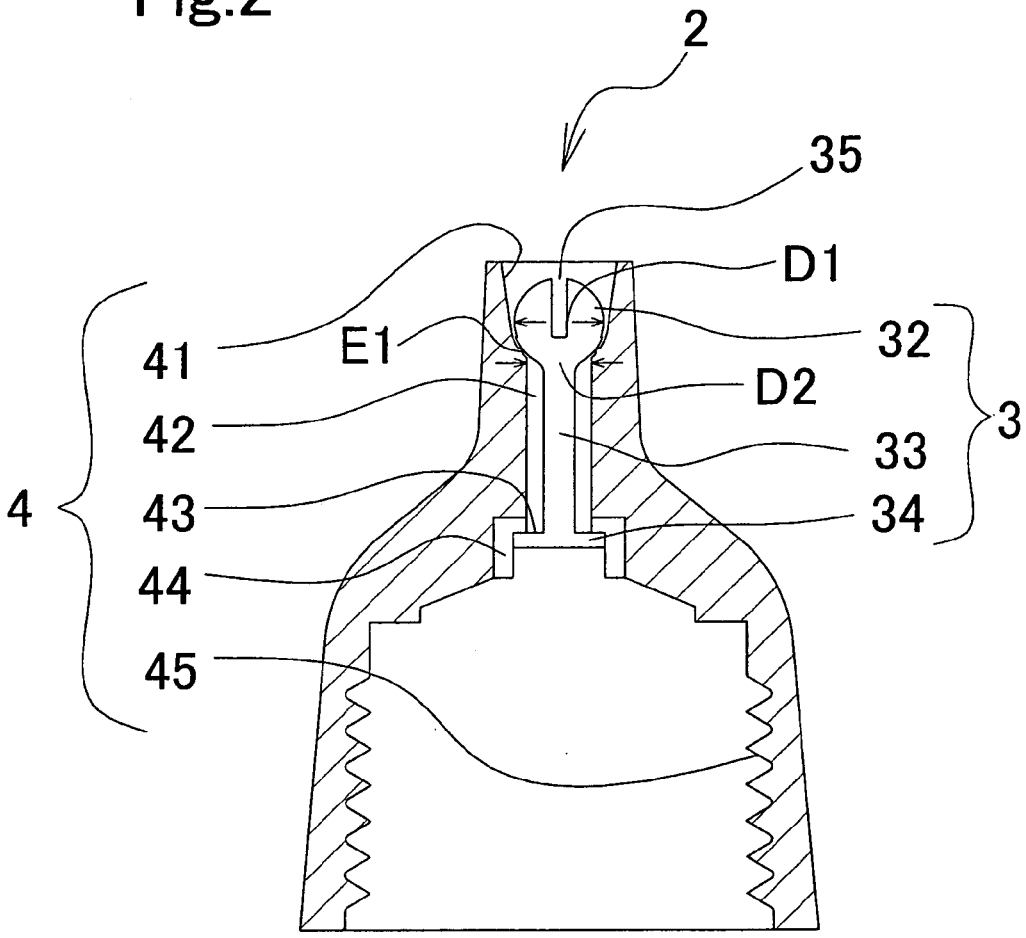
FIG. 2 is a longitudinal sectional view showing the valve mechanism 2 when no pressure is applied.
Figure 3:
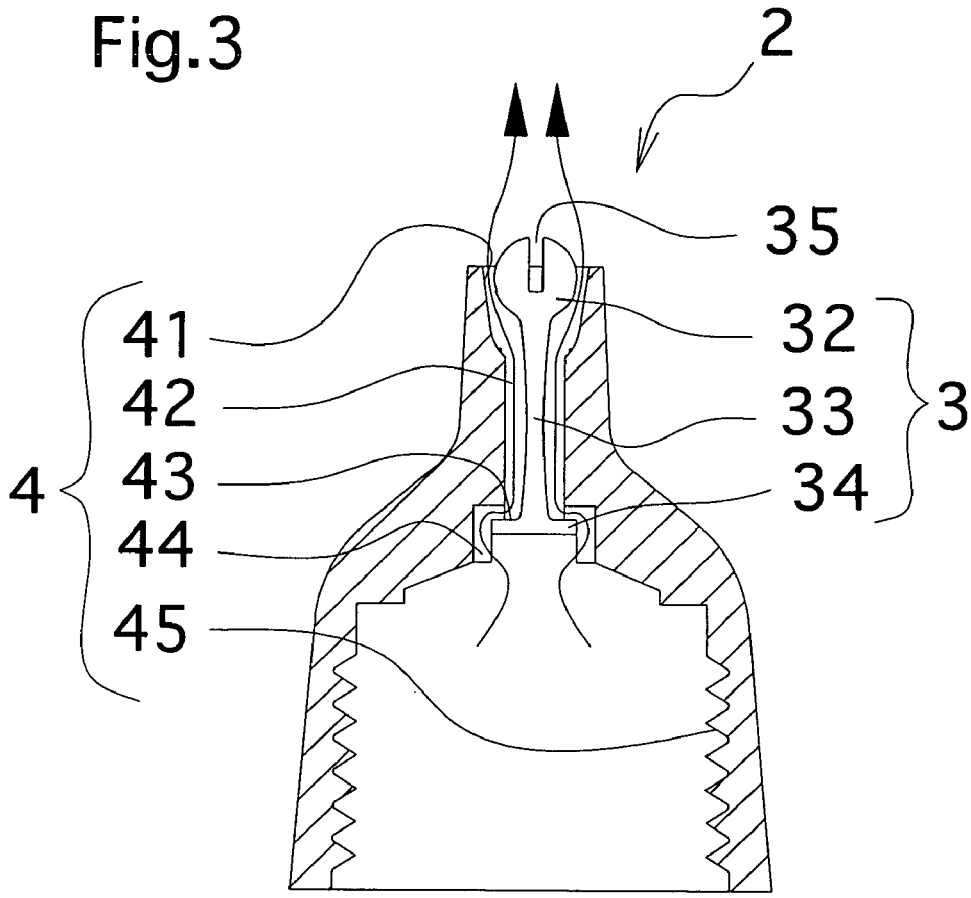
FIG. 3 is a longitudinal sectional view showing the valve mechanism 2 when pressure is applied.
Figure 4A:
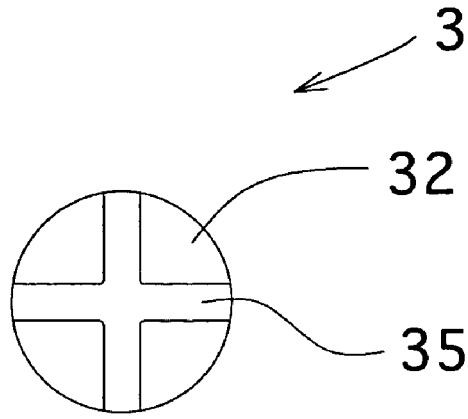
FIGS. 4A and 4B are explanatory diagrams showing the valve portion 3 of the valve mechanism 2.
Figure 4B:
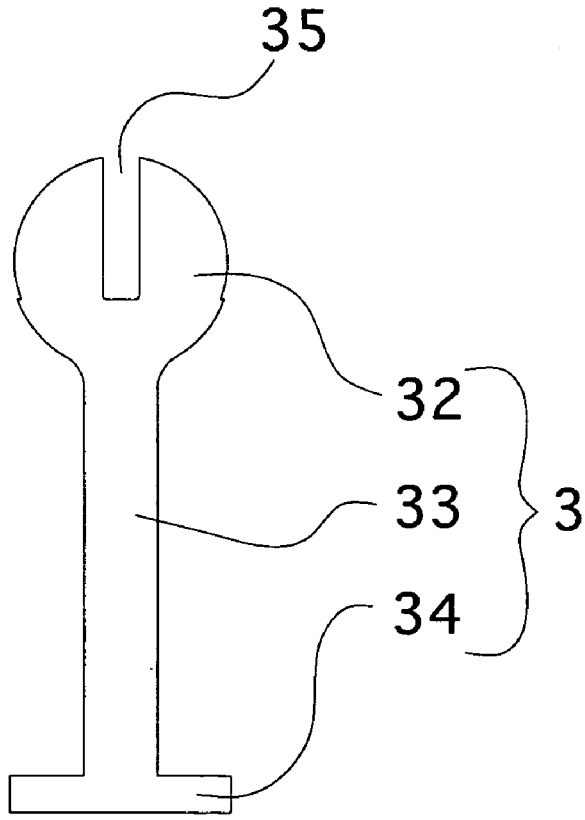

A configuration of the above-mentioned valve mechanism is described below. FIG. 2 and FIG. 3 are longitudinal sections showing the valve mechanism 2. FIGS. 4A and 4B are explanatory diagrams showing the valve portion 3 in the valve mechanism 2; FIG. 4A shows a plan view of the valve portion 3; FIG. 4B shows a lateral view of the valve portion 3.

This valve mechanism comprises a valve portion 3 and a valve seat portion 4.

The valve portion 3 has a base portion 34, a valve body 32, and a coupling portion 33 which couples the base portion 34 and the valve body 32. In the valve body 32 of the valve portion 3, a groove portion 35 having a nearly cross shape is formed. This valve portion 3 comprises an elastic body. As a material used for this valve portion 3, for example, a resin such as polyethylene and polypropylene, synthetic rubber such as silicon rubber or a mixture of these materials can be used.

The above-mentioned valve seat portion 4 has an engaging portion 43 which engages with the base portion 34 in the valve portion 3, and a valve seat body 41 which is arranged at a position separated from the engaging portion 43 at a distance corresponding to a size of the coupling portion 33 in the valve portion 3 and can contact the valve body 32 in the valve portion 3. In the vicinity of the engaging portion 43, an opening portion 44 for letting the fluid through is formed; this opening portion 44 and a fluid discharge port formed by the valve seat body 41 are coupled via a flow hole 42.

On the inner circumferential portion of the valve seat portion 4, a female screw portion 45 which can screw together with the male screw portion 14 formed on the outside of the discharge port 12 of the container main unit 1 is formed. Consequently, the valve seat portion 4 is adapted to be inserted into or removed from the discharge port 12 in the container main unit 1 by the action of the male screw portion 14 and the female screw portion 45.

As mentioned in the above, the engaging portion 43 in the valve seat portion 4 and the valve portion 41 are arranged at respective positions separated at a distance corresponding to a size of the coupling portion 33 in the valve portion 3. In other words, the flow hole 42 in the valve seat portion 4 has a size corresponding to the size of the coupling portion 33 in the valve portion 3. Consequently, in a position in which a pressure is not applied to a fluid inside the fluid storing portion 11 of the tubular container main unit 1, the valve seat body 41 in the valve seat portion 4 and the valve body 32 in the valve portion 3 are in contact as shown in FIG. 2.

In this position, by the elasticity of the coupling portion 33 in the valve portion 3, the valve seat body 41 in the valve seat portion 4 and the valve body 32 in the valve portion 3 are in contact with a certain contact pressure applied. Consequently, a fluid discharge port in the valve portion 3, which is formed with the valve seat body 41, is closed reliably.

In this position, when a pressure is applied to the fluid inside the fluid storing portion 11 in the tubular container main unit 1, the valve body 32 in the valve portion 3 separates from the valve seat body 41 in the valve seat portion 4 by the elasticity of the coupling portion 33 in the valve portion 3, as shown in FIG. 3. Consequently, the fluid discharge port in the valve portion 3, which is formed with the valve seat body 41, is opened, and the fluid to which the pressure is applied is discharged from this discharge port.

At this time, a distance between the valve body 32 in the valve portion 3 and the valve seat body 41 in the valve seat portion 4 is proportional to a pressure applied to the fluid inside the fluid storing portion 11 in the tubular container main unit 1. Consequently, because a travel distance of the valve body 32 changes according to a pressure applied to the fluid storing portion 11, i.e. a pressure applied to the valve mechanism 2, changing a discharge flow rate of the fluid discretionally becomes possible. As a result, when a regular liquid is used as a fluid, discharging the liquid drop by drop by applying a small pressure to the liquid inside the fluid storing portion 11 becomes possible as well.

When the pressure applied to the fluid storing portion 11 is removed after a necessary amount of the fluid is discharged, the fluid inside the fluid storing portion 11 is depressurized by the elasticity recovering force of the container main unit 1; the air tries to flow back toward the fluid storing portion 11 from the opening portion 12.

In this tube-type container, however, when the pressure applied to the fluid inside the fluid storing portion 11 in the tubular container main unit 1 is removed, as shown in FIG. 2, the valve seat body 41 in the valve seat portion 4 and the valve body 32 in the valve portion 3 come in contact with each other again by the elasticity of the coupling portion 33 in the valve portion 3, and the fluid discharge port in the valve portion 3, which is formed with the valve seat body 41, is closed again.

Additionally, in the embodiment shown in FIG. 1 to FIG. 4, the valve seat portion 4 is installed on the outside of the discharge port 12 in the container main unit 1 by the action of the male screw portion 14 formed in the container main unit 1 and the female screw portion 45 formed in the valve seat portion 4. The valve seat portion 4, however, can be installed on the inside of the discharge port 12 in the container main unit 1 as well.

Figure 5:
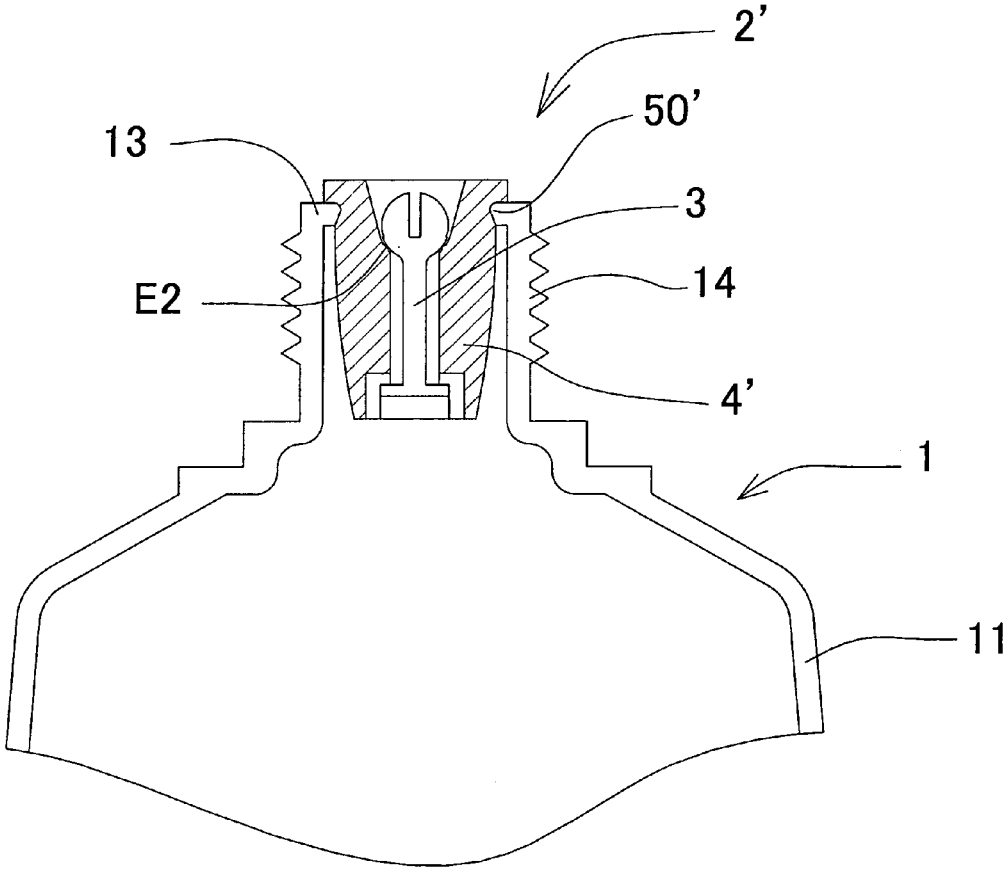
FIG. 5 is an explanatory diagram showing the valve mechanism 2'.

FIG. 5 is a longitudinal section showing the relevant part of the tube-type fluid container according to the above-mentioned modified version.

In this tube-type container, a concave portion which can engage with the flange portion 13 in the container main unit 1 is formed on the outer circumferential portion of the valve seat portion 4'. Consequently, it becomes possible to install this valve seat portion 4' on the inside of the discharge port 12 in the container main unit 1. When such a configuration is adopted, another lid body can be installed using the male screw portion 14 in the container main unit 1. Additionally, when this configuration is adopted, installing the valve mechanism 2' in a common container main unit 1 becomes possible as well.

Figure 6:
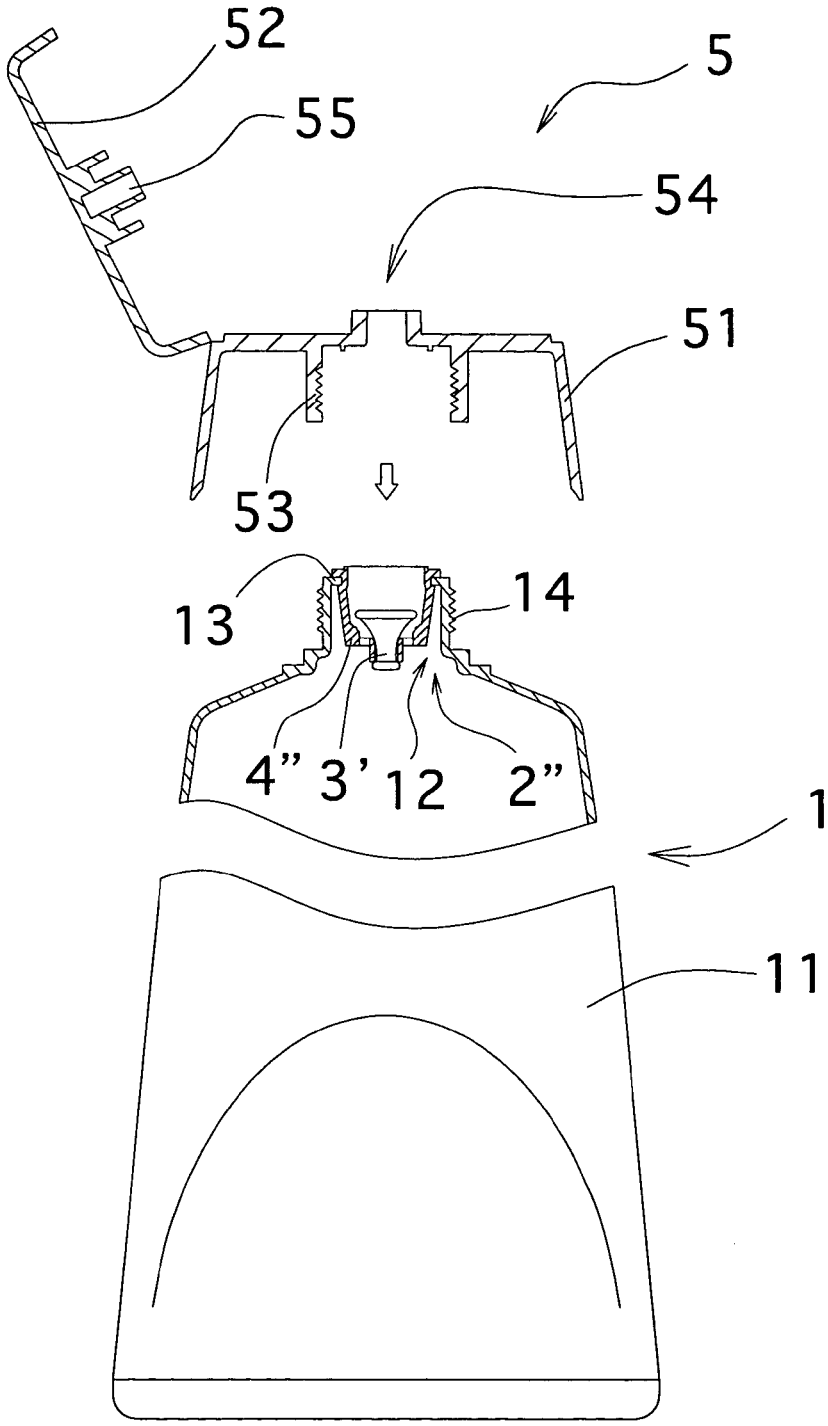
FIG. 6 is an exploded longitudinal sectional view showing the tube-type fluid container according to Embodiment 2 of the present invention.

A configuration of the tube-type fluid container according to an alternative embodiment of the present invention is described below. FIG. 6 is an exploded longitudinal section showing the tube-type fluid container according to the Embodiment 2 of the present invention.

This tube-type fluid container comprises a container main unit 1 similar to the one in the above-mentioned Embodiment 1, a valve mechanism 2" and a lid material 5.

The above-mentioned lid material 5 has a base portion 51 possessing a fluid discharge port 54 at its center, and an upper lid 52 in which a closed portion 55 closing the discharge port is formed and which can hinge with the base portion 51. In this lid material 5, with its female screw portion 53 engaging with the male screw portion 14 in the container main unit 1, the discharge port 12 in the container main unit 1 and the discharge port 54 of the lid material 5 are constructed to communicate with each other; by causing the upper lid 52 to hinge with the base portion 51, opening/closing the discharge port 5 in the lid material 5 becomes possible.

Figure 7A:
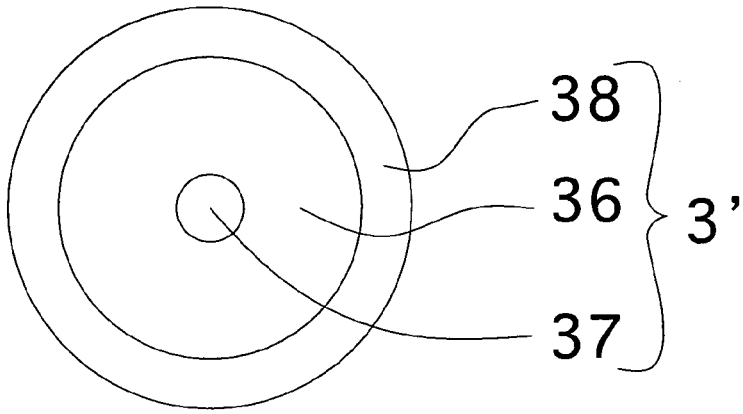
FIGS. 7A and 7B are explanatory diagrams showing the valve portion 3' used in the valve mechanism 2".
Figure 7B:
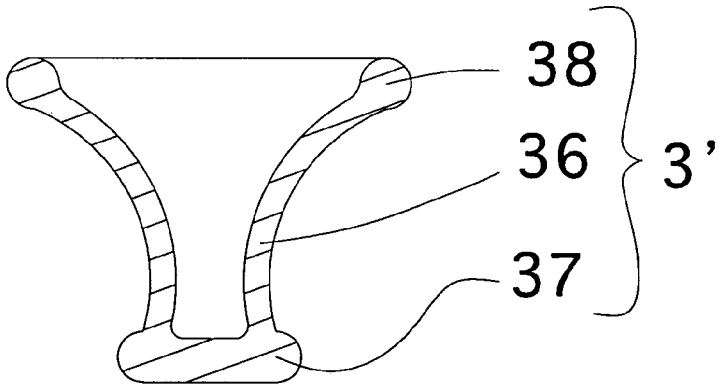
Figure 8A:
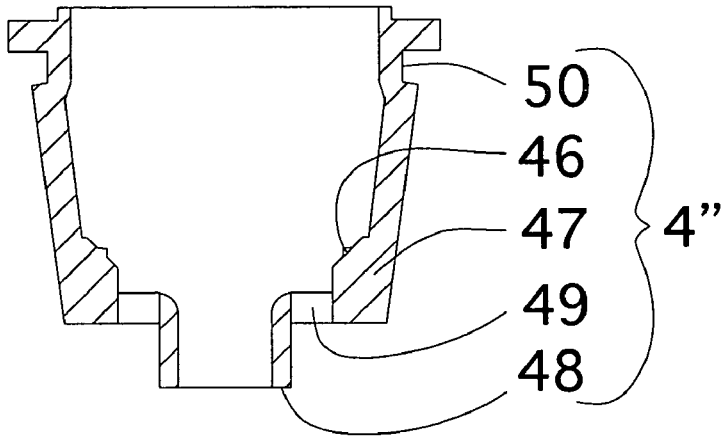
FIGS. 8A and 8B are explanatory diagrams showing the valve seat portion 4" used in the valve mechanism 2".
Figure 8B:
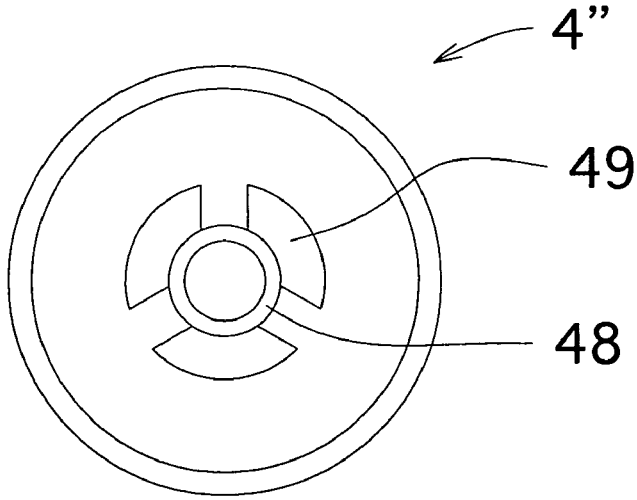
Figure 9A:
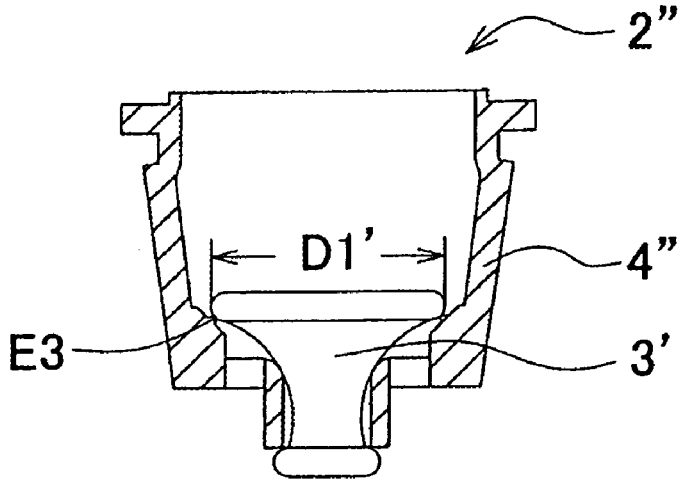
FIGS. 9A and 9B are explanatory diagrams showing fluid discharging motions by the valve mechanism 2" according to the Embodiment 2.
Figure 9B:
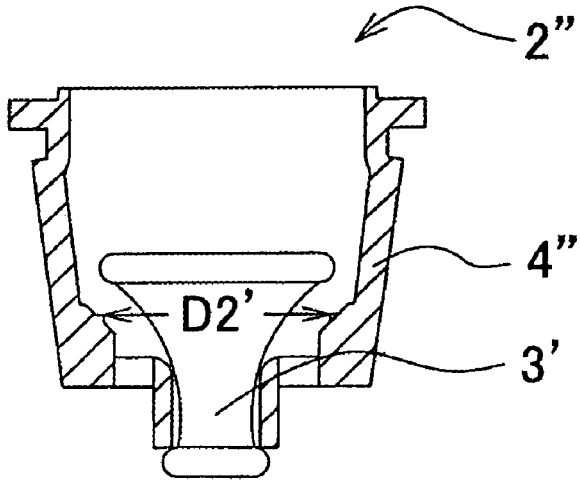

A configuration of the valve mechanism 2" according to the Embodiment 2 is described below. FIGS. 7A and 7B are explanatory diagrams showing a valve portion 3' used in the valve mechanism 2"; FIGS. 8A and 8B are explanatory diagrams showing a valve seat portion 4" used in the valve mechanism 2"; FIGS. 9A and 9B are explanatory diagrams showing fluid discharging motions by the valve mechanism 2" according to the Embodiment 2. Additionally, FIG. 7A shows a plan view of the valve portion 3'; Fib. 7B shows a lateral view of the valve portion 3'. FIG. 8A shows a longitudinal section of the valve seat portion 4; FIG. 8B shows the bottom of the valve seat portion 4".

The above-mentioned valve portion 3', as shown in FIGS. 7A and 7B, has a base portion 37, a valve body 38 and a tapered coupling portion 36 which couples the base portion 37 and the valve body 38. This valve portion 3' comprises an elastic body in the same manner as the valve portion 3' in the Embodiment 1. As a material used for this valve portion 3', for example, a resin such as polyethylene and polypropylene, synthetic rubber such as silicon rubber or a mixture of these materials can be used.

The above-mentioned valve seat portion 4", as shown in FIGS. 8A and 8B, has a tubular portion 47, an engaging portion 48 which engages with the base portion 37 in the valve portion 3', and a valve seat body 46 which is arranged at a position separated from the engaging portion 48 at a distance corresponding to a size of the coupling portion 36 in the valve portion 3' and is able to contact the valve body 38 in the valve portion 3'. Between the engaging portion 48 and the tubular portion 47, an opening portion 49 for letting the fluid through is formed; this opening portion 49 is coupled with a fluid discharge port formed by the upper end of the tubular material 47.

On the outer circumferential portion of the tubular portion 47, a concave portion 50 which can engage with the flange portion 13 in the container main unit 1 is formed. With this configuration, it becomes possible to install this valve seat portion 4" on the inside of the discharge port 12 in the container main unit 1.

As mentioned in the above, the engaging portion 48 and valve seat body 46 in the valve seat portion 4" are arranged in positions separated from each other at a distance corresponding to a size of the coupling portion 36 in the valve portion 3'. Consequently, in a position in which a pressure is not applied to the fluid inside the fluid storing portion 11 in the tubular container main unit 1, the valve seat body 46 in the valve seat portion 4" and the valve body 38 in the valve portion 3' are in contact as shown in FIG. 9A.

In this position, by the elasticity of the coupling 36 in the valve portion 3', the valve seat body 46 in the valve seat portion 4" and the valve body 38 in the valve portion 3' are in contact with a certain contact pressure applied. Consequently, the opening portion 49 in the valve portion 3' is closed reliably.

In this position, when a pressure is applied to the fluid inside the fluid storing portion 11 in the tubular container main unit 1, as shown in FIG. 9B, the valve body 38 in the valve portion 3' separates from the valve seat body 46 in the valve seat portion 4" by the elasticity of the coupling portion 36 in the valve portion 3'. Consequently, the opening portion 49 in the valve portion 3' is opened and the fluid, to which the pressure is applied, is discharged from this opening portion 49.

At this time, a distance between the valve body 38 in the valve portion 3' and the valve seat body 46 in the valve seat portion 4" is proportional to a pressure applied to the fluid inside the fluid storing portion 11 in the tubular container main unit 1. Consequently, because a travel distance of the valve body 38 changes according to a pressure applied to the fluid storing portion 11, i.e. a pressure applied to the valve mechanism 2", changing a discharge flow rate of the fluid discretionally becomes possible. As a result, when a regular liquid is used as a fluid, discharging the liquid drop by drop by applying a small pressure to the liquid inside the fluid storing portion 11 becomes possible as well.

When the pressure applied to the fluid storing portion 11 is removed after a necessary amount of the fluid is discharged, the fluid inside the fluid storing portion 11 is depressurized by the elasticity recovering force of the container main unit 1; the air tries to flow back toward the fluid storing portion 11 from the opening portion 12.

In this tube-type container, however, when the pressure applied to the fluid inside the fluid storing portion 11 in the tubular container main unit 1 is removed, as shown in FIG. 9A, the valve seat body 46 in the valve seat portion 4 and the valve body 38 in the valve portion 3' come in contact with each other again by the elasticity of the coupling portion 33 in the valve portion 3', and the opening portion 49 in the valve portion 3' is closed again.

Figure 10:
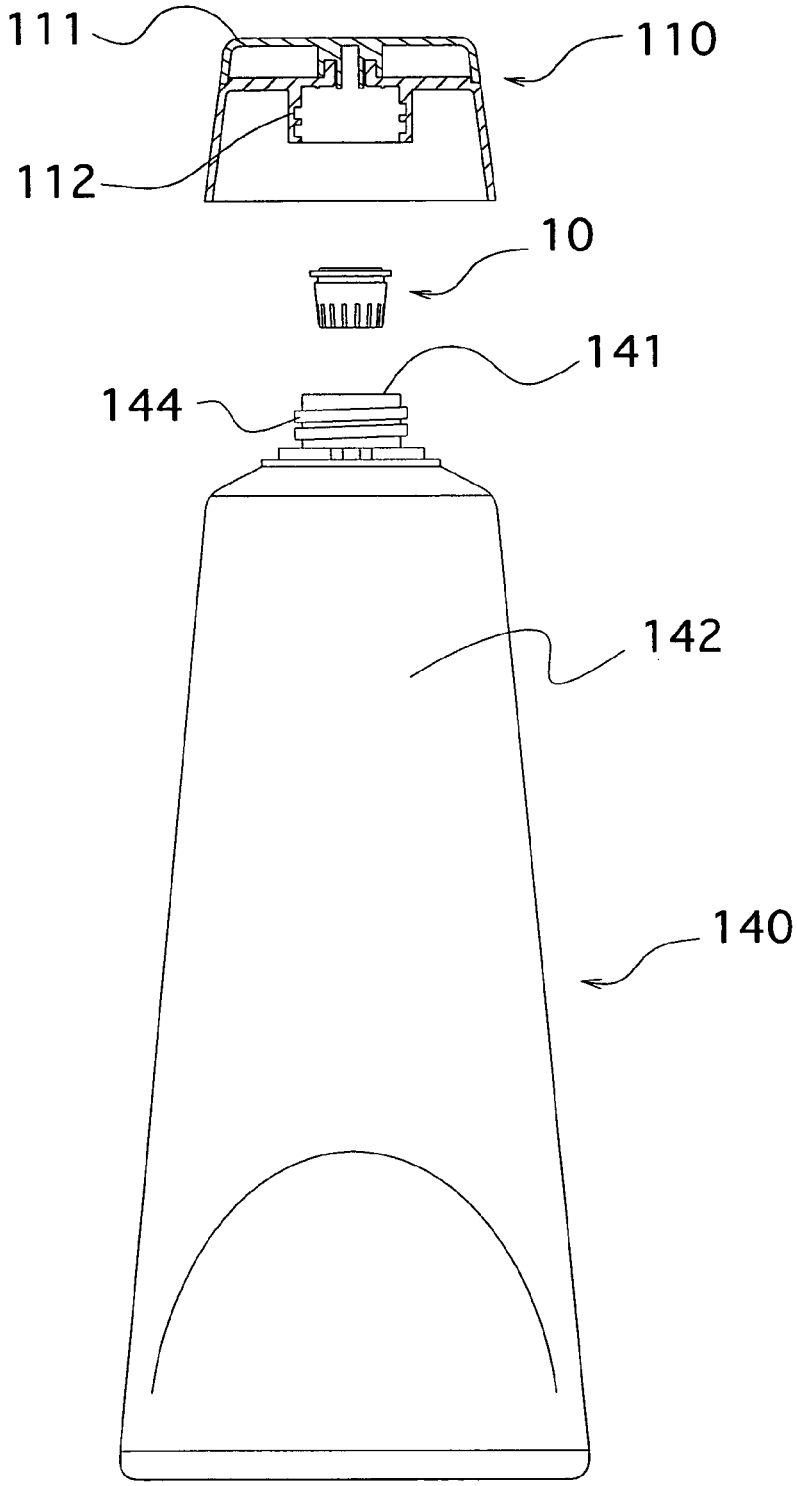
FIG. 10 is an exploded explanatory diagram showing a tube-type container to which the valve mechanism according to Embodiment 3 of the present invention applies.
Figure 11:
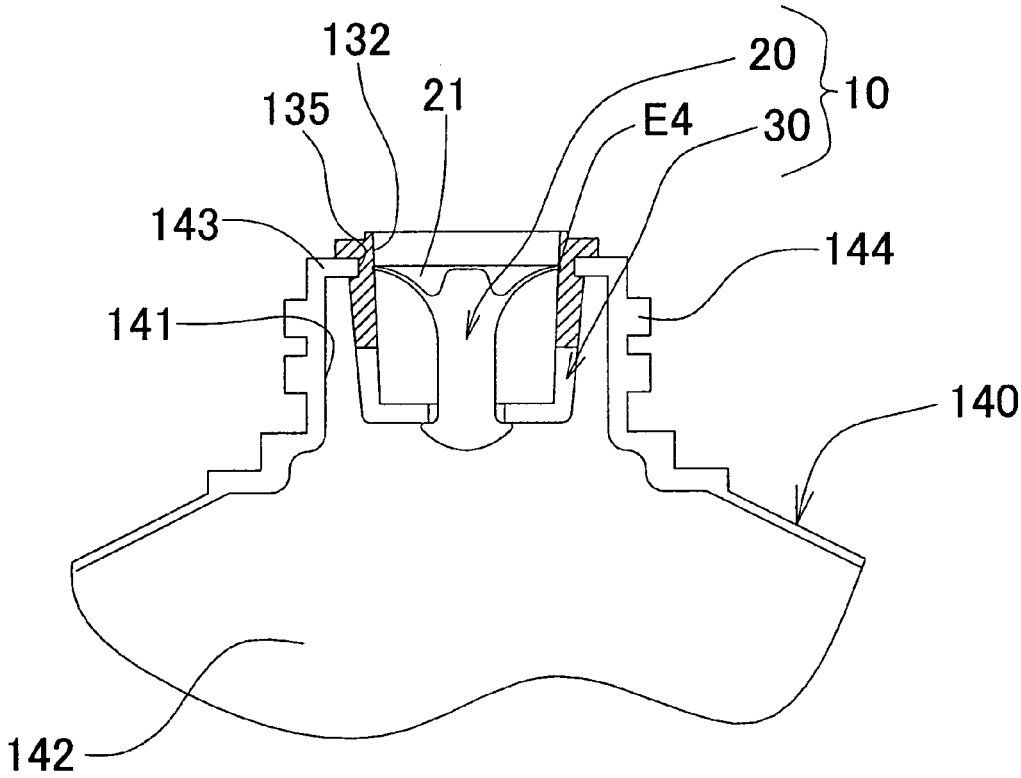
FIG. 11 is an enlarged view showing the relevant part of the tube-type container when no pressure is applied.
Figure 12:
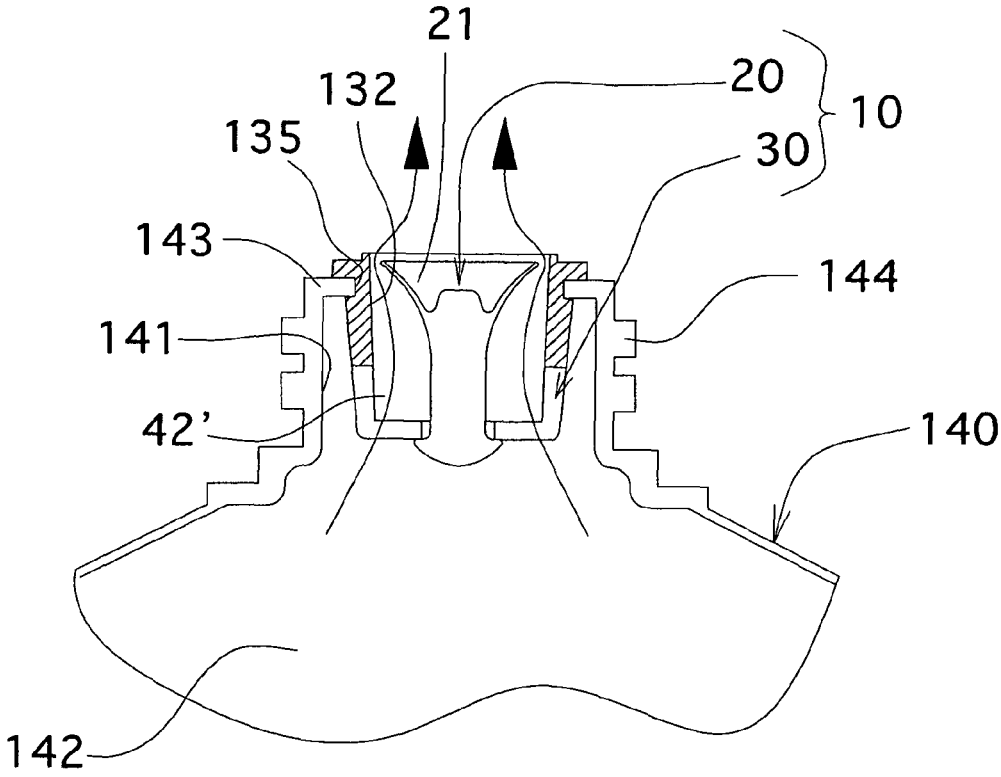
FIG. 12 is an enlarged view showing the relevant part of the tube-type container when pressure is applied.

Another preferred embodiment of the present invention is described with referent to the drawings. FIG. 10 is an exploded explanatory diagram showing a tube-type container to which the valve mechanism according to Embodiment 3 of the present invention applies. FIG. 11 and FIG. 12 are enlarged views of the relevant part of the tube-type container to which the valve mechanism according to an embodiment of the present invention applies.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

In this specification, regular liquids, high-viscosity liquids, semifluids, gels that sol solidifies to a jelly, and creams, are all referred to as fluids. The present invention, however, is not limited to a valve mechanism used for the above-mentioned fluids and can apply to a valve mechanism used for the entire fluids including gases.

This tube-type container possesses a container main unit 140, a lid material 110 which is installed at the top of the container main unit 140 and a valve mechanism 10.

The container main unit 140 comprises a fluid storing portion 142 for storing a fluid inside it, an opening portion 141 for discharging a fluid, which is formed at one end of the fluid storing portion 142, a flange portion 143 (See FIG. 11 and FIG. 12) formed in the vicinity of the opening portion 141, and a male screw portion 143 formed on the outside of the opening portion 141. The above-mentioned flange portion 143 is constructed to be able to engage with an engaging groove 135 in a coupling material 30 which is described later. Consequently, the valve mechanism 10 has a configuration in which it is fixed inside the opening portion 141 in the container main unit 140 via this engaging groove 135.

This container main unit 140 comprises a synthetic resin alone or a lamination of a synthetic resin and aluminum, and has an elasticity recovering force which tries to recover its original shape when a pressure applied to it is removed.

The above-mentioned lid material 110 possesses a lid body 111 and a female screw portion 112 formed at the center of the lid body 111. The female screw portion 112 in the lid body 111 is constructed to screw together with the male screw portion 144 in the container main unit 140.

In the tube-type container having the above-mentioned configuration, when a fluid is discharged from the container, a pressure is applied to the fluid inside the fluid storing portion 142 by pressing the fluid storing portion 142 in the container main unit 140. In this position, the valve mechanism 10 used in the valve portion 20 and the supporting material 30 is opened and the fluid inside the fluid storing portion 142 is discharged outward via the valve mechanism 10 as shown in FIG. 12.

When the pressure applied to the fluid storing portion 142 is removed after a necessary amount of the fluid is discharged, the fluid inside the fluid storing portion 142 is depressurized by the elasticity recovering force of the container main unit 140; the air tries to flow back toward the fluid storing portion 142 from the opening portion 141 for discharging the fluid.

In this tube-type container, however, a fluid flow path is closed by the action of the valve mechanism 10 comprising the valve portion 20 and the supporting material 30. Consequently, the reverse flow of the air can be prevented effectively.

A configuration of the valve mechanism 10 according to an embodiment of the present invention is described below. The valve mechanism 10 comprises the valve portion 20 and the valve seat material 30.

Figure 13A:
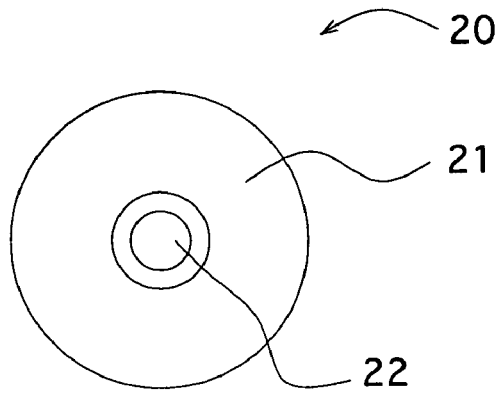
FIGS. 13A, 13B, and 13C are explanatory diagrams showing the valve portion 20 used in the valve mechanism.
Figure 13B:
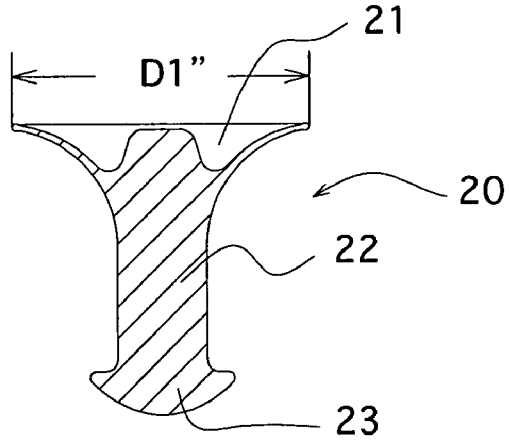
Figure 13C:
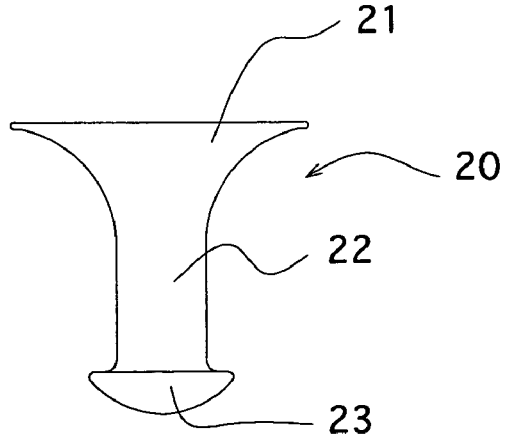

FIGS. 13A, 13B, and 13C are explanatory diagrams showing the valve portion 20 used in the valve mechanism 10 according to an embodiment of the present invention. FIG. 13A shows the top surface of the valve portion 20; FIG. 13B shows a longitudinal section of the valve portion 20; FIG. 13C shows a lateral view of the valve portion 20.

The valve portion 20 is a flexible elastic body comprising a hollow valve body 21 having a nearly conic shape, a base portion 23, a couple portion 22 which couples the valve body 21 and the base portion 23.

Figure 14A:
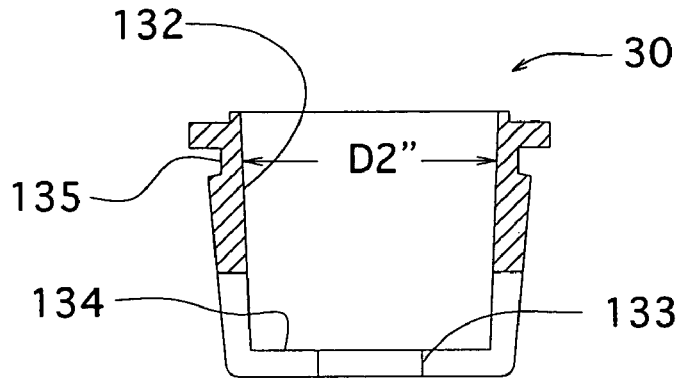
FIGS. 14A, 14B, and 14C are explanatory diagrams showing the supporting material 30 used in the valve mechanism.
Figure 14B:
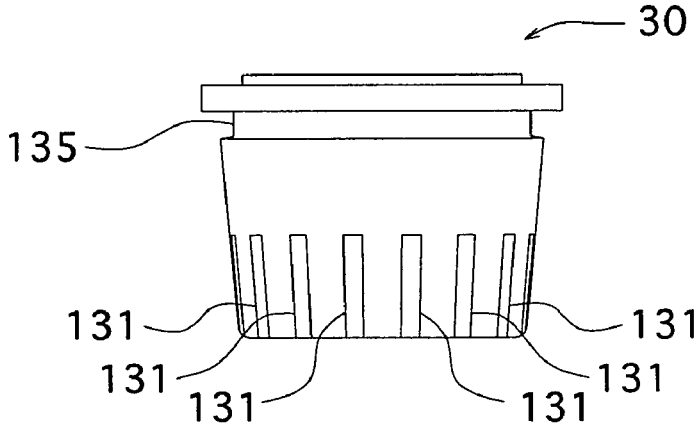
Figure 14C:
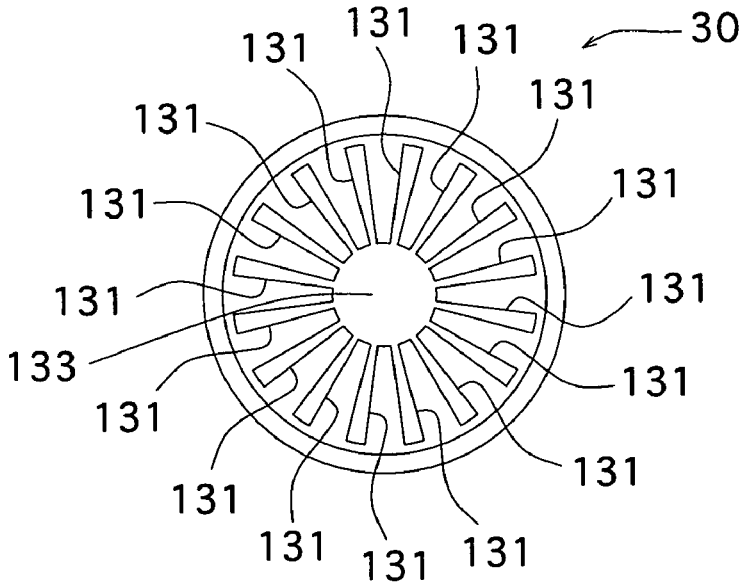

FIGS. 14A, 14B, and 14C are explanatory diagrams showing the supporting material 30 used in the valve mechanism 10 according to an embodiment of the present invention. FIG. 14A shows a longitudinal view of the supporting material 30; FIG. 14B shows a lateral view of the supporting material 30; FIG. 14C shows the bottom of the supporting material 30.

The supporting material 30, as shown in FIGS. 14A, 14B, and 14C, has a tubular shape with a bottom, whose inside diameter is smaller than the maximum outside diameter of the valve body 21 in the valve portion 20. The supporting material 30 has an inner circumferential surface which contacts the valve body 21 of the vale material 20 and possesses the engaging portion 133 at its bottom 134, which engages with the base portion 23 in the valve portion 20. The inner circumferential surface 132 of the supporting material 30 has a tapered shape whose inside diameter becomes larger as it separates from the bottom 134. Additionally, in an area which is closer to the bottom side 34 than an area in which the inner circumferential surface 132 of the supporting material 30 and the valve body 21 of the vale material 20 come in contact with each other, flow holes 131 are formed. By engaging the engaging portion 134 of the supporting material 30 with the base portion 23 in the valve portion 20, the valve portion 20 is fixed with the supporting material 30.

As a material used for the valve portion 20, for example, rubber such as silicon rubber or a flexible resin such as flexible polyethylene can be used. As a material used for the supporting material 30, a hard resin such as hard polyethylene can be used. The valve portion 20 and the supporting material 30 are produced by injection molding.

In the valve mechanism 10 having this configuration, when a pressure is applied to a fluid inside the fluid storing portion 142 by pressing the fluid storing portion 142 of the container main unit 140 as shown in FIG. 10, the pressurized fluid flows into the supporting material 30 from the flow holes 131. By this, the valve portion 20 is pressurized by the fluid; the maximum outside diameter of the valve body 21 becomes smaller than an inside diameter of the supporting material 30 by the flexibility of the valve body 21 in the valve portion 20. Consequently, with the valve body 21 separating from the inner circumferential surface 132 of the supporting material 30, a fluid path is formed. When the pressure applied to the fluid storing portion 142 is removed, by the elasticity recovering force of the valve body 21, the inner circumferential surface 132 of the supporting material 30 comes in contact with the valve body 21 of the valve portion 20 again. By this, air intrusion into the fluid storing portion 142 can be prevented.

In this valve mechanism, because the maximum external form of the valve body 21 is changed according to a pressure applied to the fluid storing portion 142, i.e. a pressure applied to the valve mechanism 10, changing a flow rate of the fluid passing through the valve mechanism 10 discretionally becomes possible. Consequently, when a regular liquid is used as a fluid, discharging the liquid drop by drop by applying a small pressure to the liquid inside the fluid storing portion 142 becomes possible as well.

Additionally, a pressure applied to a fluid inside the fluid storing portion 142 and a discharge amount of the fluid can be adjusted as well by changing a thickness or the maximum external form of the valve body 21, an inside diameter of the supporting material 30 or materials (hardness) of these portions.

The reason for adopting the inner circumferential surface 132 in the supporting material 30, which has a tapered shape whose inside diameter becomes larger as it separates from the bottom 134, is as follows: Even if an amount of deformation of the valve body 21 is minute, when the supporting material 30 having the above-mentioned tapered shape is adopted, securing clearance gaps used for discharging the fluid becomes possible by elongation of the elastic valve body 21 itself, as compared with those not having a tapered shape.

Furthermore, in respective embodiments mentioned above, although the present invention may be applied to the valve mechanisms used for fluids, the present invention can be applied to valve mechanisms used for gases. In these cases, by using a material having high rigidity for the valve portion, stronger momentum should be given to the closing portion toward the valve seat.

In the present invention, any suitable plastic material can be used including rubbers such as silicon rubbers or soft resins such as soft polyethylene. For support portions (such as the valve seat portion) to which other portions (such as the valve portion) are fitted by press-fitting, hard resins such as hard polyethylene can preferably be used. The structures can be formed by any suitable methods including injection molding. The resin material can be selected based on the type of fluid stored in the container. If a high viscose fluid such as a gel is stored in the container, a hard resin may be used for the valve mechanism. If a low viscose fluid such as a thin liquid or a formed liquid is stored in the container, a more resilient resin may be used for the valve mechanism.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A valve mechanism adapted for a mouth portion of a tube-shaped fluid container, comprising:

a valve seat portion having an upper opening portion and a lower opening portion through both of which a fluid passes when in use, said upper opening portion having an annular convex portion, said valve seat portion adapted to be attached to the mouth portion of the container, wherein the upper opening portion and the lower opening portion are integrally formed; and a valve portion disposed co-axially with the upper opening portion, comprising: (i) a supporting portion supported by the valve seat portion at or below the lower opening portion without closing the lower opening portion; (ii) a closing portion for closing the upper opening portion wherein the upper opening portion is closed by placing the closing portion in edge contact with the annular convex portion, said closing portion having an outer diameter larger than an inner diameter of the upper opening portion; and (iii) a connecting portion connecting the closing portion and the supporting portion, wherein at least either the closing portion or the connecting portion is resilient and capable of being deformed to open the upper opening portion when a fluid stored inside the container is pressed, wherein the supporting portion, the closing portion, and the connecting portion are integrally formed.

2. The valve mechanism according to claim 1, wherein the connecting portion is resilient and capable of being stretched in a direction of the fluid flow.

3. The valve mechanism according to claim 2, wherein the valve seat portion constitutes a nozzle and the closing portion of the valve portion is spherically shaped, wherein the upper opening portion is shaped to fit for the spherically shaped closing portion.

4. The valve mechanism according to claim 1, wherein the closing portion is a resilient annular edge portion which is capable of being deformed in a direction of the fluid flow.

5. The valve mechanism according to claim 4, wherein the connecting portion has an outer circumferential surface which is tapered outward in a direction of the fluid flow.

6. The valve mechanism according to claim 4, wherein the valve seat portion is cup-shaped, and the upper opening portion is formed by an inner circumferential surface of the cup-shaped valve seat portion, wherein a periphery of the resilient annular edge portion is in edge contact with the inner circumferential surface of the cup-shaped valve seat portion to close the upper opening portion when a fluid stored inside the container is not pressed.

7. The valve mechanism according to claim 1, wherein the valve seat portion has a shape to be fitted in an inner circumferential portion of the mouth portion of the container.

8. The valve mechanism according to claim 1, wherein the valve seat portion has a shape to be fitted around an outer circumferential portion of the mouth portion of the container.

9. The tube-shaped fluid container comprising a container body for storing the fluid having the mouth portion, and the valve mechanism of claim 1 attached to the mouth portion.

10. The tube-shaped fluid container according to claim 9, wherein the valve seat portion of the valve mechanism is fitted in the mouth portion, wherein the mouth portion has an annular flange and the valve seat portion has an outer circumferential surface having an annular recess fitted in the flange.

11. The tube-shaped fluid container according to claim 10, further comprising a lid portion having a discharge hole, wherein the mouth portion has an outer circumferential surface provided with male threads, and the lid portion has an inner circumferential surface connected to the discharge hole and provided with female threads fitted to the male threads.

12. The tube-shaped fluid container according to claim 9, wherein the valve seat portion of the valve mechanism is fitted around an outer circumferential surface of the mouth portion, wherein the outer circumferential surface is provided with male threads and the valve seat portion has an inner circumferential surface provided with female threads fitted to the male threads.

13. The valve mechanism according to claim 1, wherein the valve portion has an upwardly widening trumpet shape.

14. The valve mechanism according to claim 1, wherein the upper opening portion is provided with a protrusion with which the closing portion is in edge contact to close the upper opening portion.

15. The valve mechanism according to claim 1, wherein the closing portion and the connecting portion are formed in a hollow trumpet shape.

16. The valve mechanism according to claim 15, wherein the closing portion has a thickness greater than a thickness of the connecting portion.

17. The valve mechanism according to claim 1, wherein the connecting portion has a cross section taken in an axial direction which is curved in the axial direction.

18. A valve mechanism adapted for a mouth portion of a tube-shaped fluid container, comprising:

a valve seat portion having an upper opening portion and a lower opening portion through both of which a fluid passes when in use, said valve seat portion adapted to be attached to the mouth portion of the container; and a valve portion disposed co-axially with the upper opening portion, comprising: (i) a supporting portion attached at or below the lower opening portion without closing the lower opening portion, (ii) a closing portion for closing the upper opening portion, said closing portion having an outer diameter larger than an inner diameter of the upper opening portion; and (iii) a connecting portion connecting the closing portion and the supporting portion, wherein at least either the closing portion or the connecting portion is resilient and capable of being deformed to open the upper opening portion when a fluid stored inside the container is pressed, wherein the closing portion is a resilient annular edge portion which is capable of being deformed in a direction of the fluid flow, wherein the resilient annular edge portion is hollow.

19. A valve mechanism adapted for a mouth portion of a tube-shaped fluid container, comprising:

a valve seat portion having an upper opening portion and a lower opening portion through both of which a fluid passes when in use, said valve seat portion adapted to be attached to the mouth portion of the container, wherein the lower opening portion of the valve seat portion comprises multiple slits each formed in a radial direction; and a valve portion disposed co-axially with the upper opening portion, comprising: (i) a supporting portion attached at or below the lower opening portion without closing the lower opening portion, (ii) a closing portion for closing the upper opening portion, said closing portion having an outer diameter larger than an inner diameter of the upper opening portion; and (iii) a connecting portion connecting the closing portion and the supporting portion, wherein at least either the closing portion or the connecting portion is resilient and capable of being deformed to open the upper opening portion when a fluid stored inside the container is pressed, wherein the closing portion is a resilient annular edge portion which is capable of being deformed in a direction of the fluid flow.

20. A valve mechanism A valve mechanism adapted for a mouth portion of a tube-shaped fluid container, comprising:

a valve seat portion having an upper opening portion and a lower opening portion through both of which a fluid passes when in use, said valve seat portion adapted to be attached to the mouth portion of the container; and a valve portion disposed co-axially with the upper opening portion, comprising: (i) a supporting portion attached at or below the lower opening portion without closing the lower opening portion, (ii) a closing portion for closing the upper opening portion, said closing portion having an outer diameter larger than an inner diameter of the upper opening portion; and (iii) a connecting portion connecting the closing portion and the supporting portion, wherein at least either the closing portion or the connecting portion is resilient and capable of being deformed to open the upper opening portion when a fluid stored inside the container is pressed, wherein the connecting portion is resilient and capable of being stretched in a direction of the fluid flow, wherein the valve seat portion constitutes a nozzle and the closing portion of the valve portion is spherically shaped, wherein the upper opening portion is shaped to fit for the spherically shaped closing portion, wherein the spherical valve portion has recesses on its top.

21. The valve mechanism according to claim 20, wherein the supporting portion, the closing portion, and the connecting portion are integrally formed.

* * * * *